US005307534A

United States Patent [19]

Miller

[11] Patent Number: 5,307,534

[45] Date of Patent: May 3, 1994

[54] PORTABLE ROTARY COPPER PIPE CLEANER

[76] Inventor: Richard P. Miller, 309 Channahon, Shorewood, Ill. 60436

[21] Appl. No.: 17,422

[22] Filed: Feb. 8, 1993

[51] Int. Cl.[5] ..... B08B 9/02; A46B 13/02

[52] U.S. Cl. ..... 15/4; 15/22.1; 15/23; 15/88; 15/104.04; 15/104.05; 15/104.095; 51/170 PT; 51/181 NT

[58] Field of Search ..... 15/4, 22.1, 23, 88, 15/104.03, 104.04, 104.05, 104.095; 51/73 R, 170 PT, 181 R, 181 NT

[56] References Cited

U.S. PATENT DOCUMENTS

| | | | |
|---|---|---|---|
| 3,188,674 | 6/1965 | Hobbs | 15/104.04 |
| 4,238,867 | 12/1980 | Ruggero et al. | 15/88 |
| 4,850,071 | 7/1989 | Lawrence | 15/104.095 |
| 5,038,525 | 8/1991 | Gardner | 15/104.03 |
| 5,056,265 | 10/1991 | Hurst | 15/104.04 |
| 5,099,537 | 3/1992 | Denny | 15/104.03 |

*Primary Examiner*—Edward L. Roberts
*Attorney, Agent, or Firm*—Hugh E. Smith

[57] ABSTRACT

A multi-purpose rotary pipe or tubing cleaner especially adapted for cleaning copper pipe and fittings for sweat soldering joints having rotary internal and external brushes and an internal reamer.

2 Claims, 3 Drawing Sheets

PORTABLE ROTARY COPPER PIPE CLEANER

BACKGROUND OF THE INVENTION

1. Field of the Invention

The present invention relates to pipe or tubing cleaners and more particularly pertains to such cleaners specific for preparing sweat soldering joints in copper pipe.

2. Description of the Prior Art

The use of pipe cleaning brushes is known in the prior art. More specifically, cleaners heretofore devised and utilized for the purpose of cleaning pipe are known to consist basically of familiar, expected and obvious structural configurations, notwithstanding the myriad of designs encompassed by the crowded prior art which have been developed for the fulfillment of countless objectives and requirements.

Most plumbers use hand brushes and/or reamers for preparing copper joints. Suggestions have been made in the prior art for cleaning regular, i.e. steel pipe using powered, rotary brushes for example, U.S. Pat. Nos. 3,604,040; 4,862,549; 3,824,646; 4,667,548; and 3,900,911.

In this respect, the rotary cleaner according to the present invention substantially departs from the conventional concepts and designs of the prior art, and in so doing provides an apparatus primarily developed for the purpose of preparing copper joints for sweat soldering.

Therefore, it can be appreciated that there exists a continuing need for new and improved cleaners which can be powered and portable. In this regard, the present invention substantially fulfills this need.

SUMMARY OF THE INVENTION

In view of the foregoing disadvantages inherent in the known types of tubing cleaners now present in the prior art, the present invention provides an improved tool. As such, the general purpose of the present invention, which will be described subsequently in greater detail, is to provide a new and improve powered rotary cleaner for copper tubing which has all the advantages of the prior art and none of the disadvantages.

To attain this, the present invention comprises a cylindrical tool holder sized to be conveniently held in the hand and containing a variable speed electric motor powered by self-contained rechargeable batteries. A properly sized external pipe cleaning brush member is mounted at one end of the tool holder and a corresponding properly sized external brush member is mounted at the other end. These brushes are removeably engaged with a drive shaft extending from each end of the motor and adapted to be rotated thereby. The external brush is also provided with an internal reamer for the pipe to be cleaned.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pipe cleaner which has all the advantages of the prior art tools and none of the disadvantages.

It is another object of the present invention to provide a new and improved rotary , powered pipe cleaner which may be easily and efficiently manufactured and marketed.

It is a further object of the present invention to provide a new and improved rotary pipe cleaner which is of a durable and reliable construction.

An even further object of the present invention is to provide a new and improved powered, rotary pipe cleaner which is susceptible of a low cost of manufacture with regard to both materials and labor, and which accordingly is then susceptible of low prices of sale to the consuming public, thereby making such tools economically available to the buying public.

Still another object of the present invention is to provide a new and improved powered rotary cleaner specifically designed for copper tubing joints.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
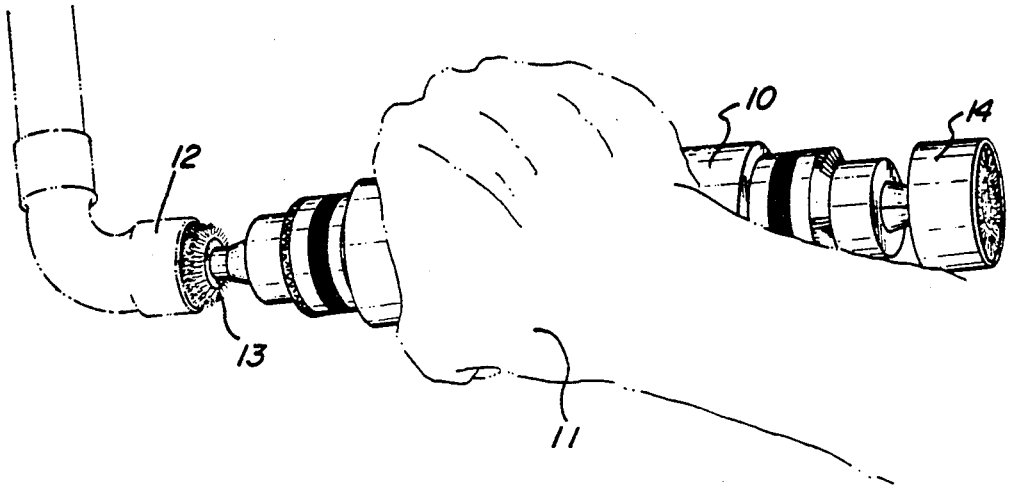
FIG. 1 is a perspective view of the tool of the present invention in use.

With reference now to the drawings, and in particular to FIG. 1 thereof, a new and improved powered, rotary hand tool for preparing copper tubing joints embodying the principles and concepts of the present invention and generally designated by the reference numeral 10 will be described.

More specifically, it will be noted that the tool 10 comprises a cylindrical body having four arcuate indentations colinearly and longitudinally arranged for engagement with a user's hand and is properly sized to be easily grasped with the hand 11 and applied to the workpiece 12. An internal cleaning brush 13 is rotatably mounted at one end of tool 10 while an external tubing cleaning brush 14 is mounted at the other end.

Figure 2:
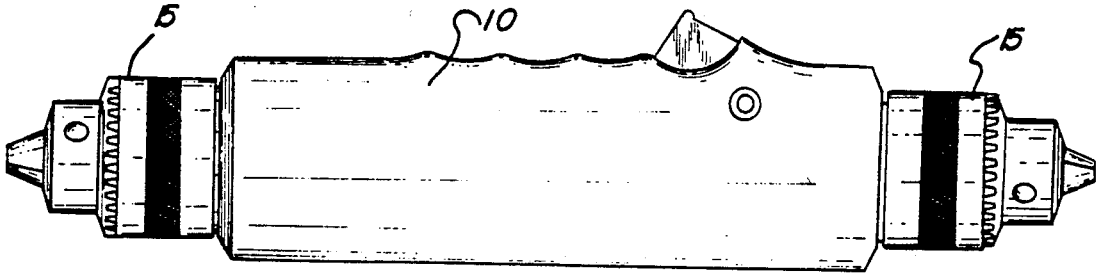
FIG. 2 is a side elevation of the tool shown in FIG. 1.

Referring to FIG. 2, the tool 10 is shown with rotatable chuck members 15 mounted at each end to receive the brushes shown in FIG. 1.

Figure 3:
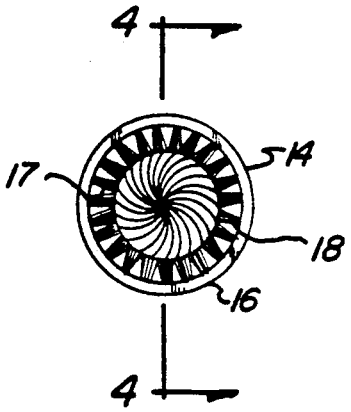
FIG. 3 is a front or end-on view of the external brush used in the present invention.

FIG. 3 shows an end-on view of the external tubing cleaning brush 14 of FIG. 1. This brush consists of a cylindrical housing 16 having a plurality of inwardly extending bristles 17 mounted thereon and a centrally positioned reamer 18 mounted therein. The reamer 18 is substantially conical in shape and has a plurality of helical ridges extending outwardly from a center thereof. The bristles are made of wire, plastic or similar materials.

Figure 4:
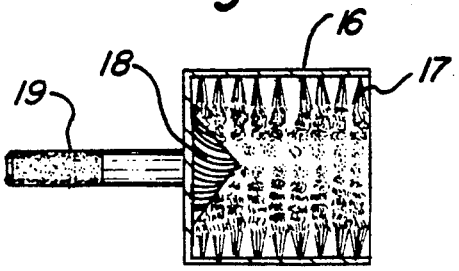
FIG. 4 is a sectional view taken on line 4—4 of FIG. 3.

FIG. 4 more clearly shows the relationship of reamer 18 and bristles 17 within housing 16, and also shows the shaft 19 extending from housing 16 of the brush member. Shaft 19 is adapted to be engaged within chuck 15 shown in FIG. 2.

Figure 5:
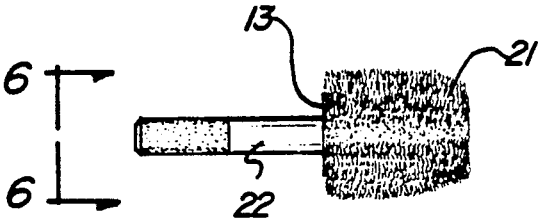
FIG. 5 is a side plan view of the internal brush use in the present invention.
Figure 6:
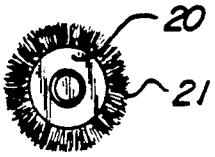
FIG. 6 is a sectional view of the brush of FIG. 5 taken on line 6—6 of FIG. 5.

FIGS. 5 and 6 illustrate the internal cleaning brush 13 of the present invention. Such brush consists of a cylindrical housing 20 having a plurality of cleaning bristles 21 extending outwardly therefrom. Like the external brush 14, brush 13 has a shaft 22 extending from housing 20 to permit mounting in chuck 15 as shown in FIG. 2.

Figure 7:
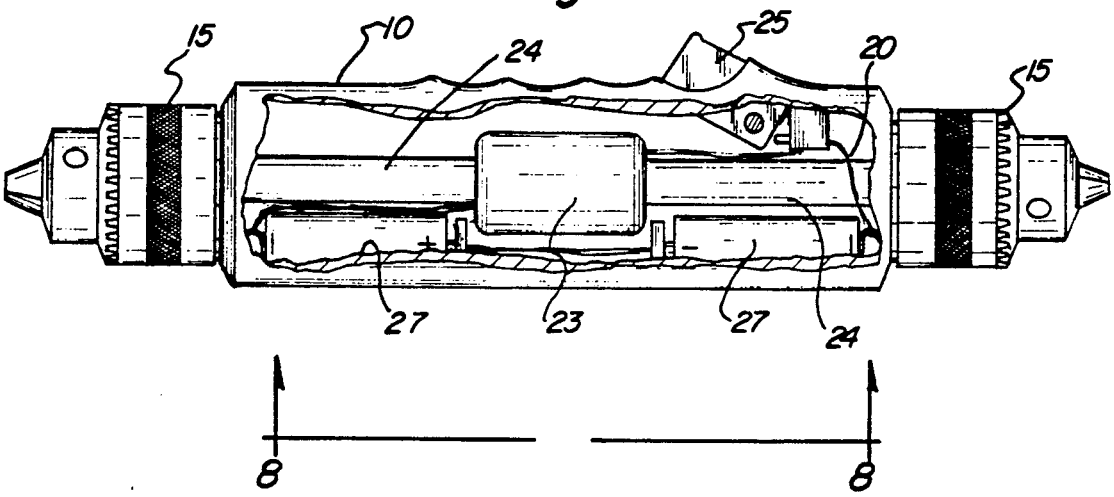
FIG. 7 is a partially exploded side elevation of the tool shown in FIG. 2 illustrating the internal components of such tool.

FIG. 7 illustrates the interior of tool 10 shown in FIG. 2. A variable-speed motor 23 is centrally located within the tool 10 with a shaft 24 extending from each end thereof. Affixed to each end of such shaft 24 external of tool 10 is a chuck 15 adapted to fixedly engage with shafts 19 and 22 of the brush members shown in FIGS. 4 and 5 respectively. A manual switch 25 is connected by a wire 26 to internally mounted batteries 27. The manual switch 25 is mounted partially within the cylindrical body and extends partially through a rectangularly shaped aperture extending through one of the indentations of the cylindrical body which facilitates an operation of the switch by a user.

Figure 8:
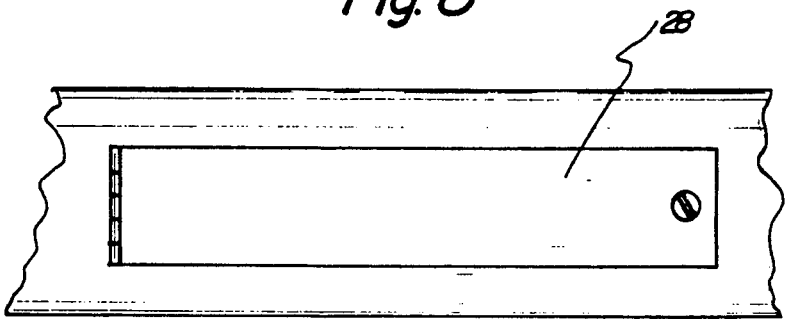
FIG. 8 is a partial bottom view of the tool of FIG. 7 illustrating the access port for battery replacement.

FIG. 8 taken on line 8—8 of FIG. 7 illustrates an access port 28 to permit insertion and removal of batteries 27.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new rotary tool for preparing copper tubing for soldering comprising a generally cylindrical body having four arcuate indentations colinearly and longitudinally arranged for engagement with a user's hand, one of said indentations being substantially slightly deeper than the remaining indentations and shaped in such a manner so as to define a longitudinally oriented rectangularly shaped aperture;

a motor electrically connectable to a battery and positioned within said cylindrical body and having a pair of oppositely extending shafts which project exteriorly of said cylindrical body;

a pair of rotatably tightenable chucks, each of said chucks being fixedly secured to one of said shafts;

an internal cleaning brush removably coupled to one of said chucks, said internal cleaning brush comprising a cylindrical housing having a plurality of wire cleaning bristles extending outwardly therefrom;

an external cleaning brush removably coupled to another of said chucks, said external cleaning brush comprising a further cylindrical housing having a further plurality of wire bristles extending inwardly therefrom, and a centrally positioned reamer mounted within said further cylindrical housing, said reamer being conical in shape and having helical ridges extending outwardly from a center thereof; and, a switch electrically connected to said motor and electrically connectable to said battery, said switch being positioned partially within said cylindrical body and extending partially through said rectangularly shaped aperture for operation thereof by a user.

2. The new rotary tool for preparing copper tubing for soldering of claim 1, and further comprising an access port formed in said cylindrical body for permitting an insertion of said battery within said cylindrical body.

* * * * *